US005519971A

United States Patent [19]

Ramirez

[11] Patent Number: 5,519,971

[45] Date of Patent: May 28, 1996

[54] BUILDING PANEL, MANUFACTURING METHOD AND PANEL ASSEMBLY SYSTEM

[76] Inventor: Peter B. Ramirez, 1954 Meridian Ave., San Jose, Calif. 95125

[21] Appl. No.: 187,852

[22] Filed: Jan. 28, 1994

[51] Int. Cl.[6] ..... E04C 2/52

[52] U.S. Cl. ..... 52/220.2; 52/309.9; 52/586.1; 52/589.1

[58] Field of Search ..... 52/309.9, 309.11, 52/276, 241, 220.1, 220.2, 220.7, 578, 586.1, 589.1, 581, 309.4

[56] References Cited

U.S. PATENT DOCUMENTS

| | | | |
|---|---|---|---|
| 3,363,378 | 1/1968 | Palfey . | |
| 3,462,897 | 8/1969 | Weinrott . | |
| 4,163,349 | 8/1979 | Smith . | |
| 4,578,909 | 4/1986 | Henley . | |
| 4,852,316 | 8/1989 | Webb | 52/796.1 X |
| 5,245,809 | 9/1993 | Harrington . | |

OTHER PUBLICATIONS

Automated Builder Magazine, Jul. 1994, p. 10, article re: "Heavy, High–Pressure Molds . . . " by Don Carlson.

*Primary Examiner*—Creighton Smith
*Attorney, Agent, or Firm*—Robert O. Guillot

[57] ABSTRACT

The improved sandwich panel of the present invention includes inner and outer panel faces that have a foam core integrally bonded therebetween by the hardening and curing of a liquid foam during the manufacturing process. The faces of the preferred panel embodiments are composed of cement-fiber boards and/or cement-woodchip boards. The preferred sandwich panel has a male projecting lateral edge on one side and a female recess in the core on the opposite side edge.

The preferred method of manufacturing the panels includes the installation of the male edge member prior to foaming and the utilization of edge recess forming members installed at the edges of the panel assembly prior to the insertion of liquid foam therebetween. The removal of the edge recess forming members following the curing of the foam easily creates the edge recesses.

The method of construction of a structure utilizing the improved panel includes the installation of a bottom sill to a foundation or floor, the engagement of panel members to the bottom sill and to each other through the male-female side edge interconnection and the placement of a continuous top plate within the top edge recesses of the panels. Thereafter, by nailing, the assembled panels are engaged to the bottom sill, to each other through the male-female interconnection and the top sill.

5 Claims, 5 Drawing Sheets

BUILDING PANEL, MANUFACTURING METHOD AND PANEL ASSEMBLY SYSTEM

BACKGROUND OF THE INVENTION

1. Field of the Invention

The present invention relates generally to sandwich panels for building construction, and more particularly to an improved foam core sandwich panel, a method for the manufacture thereof, and a panel assembly system for the panelized construction of buildings.

2. Description of the Prior Art

The industry of panelizers, which includes the pre-cutter, the conventional 2×4 wall panelizers, the more exotic dome home, log home, timber frame, foam core panels and other alternative housing segments, is the housing industry of the future. The many advantages of panelized housing include better price, less labor costs, less costs of design and engineering, better quality, less time of construction, and better return on investment.

The new trend will be the use of foam core panel construction for interior and exterior walls, floor and ceiling/roof components. The foam core panels give the building even greater strength than 2×4 stud walls with far fewer pieces. The resulting building itself is extremely well insulated, weather tight, and virtually sound proof.

U.S. Pat. No. 3,363,378, Building Panel and Method of Assembly; U.S. Pat. No. 3,482,897, Building Construction and Residential Building and Method of Fabricating Thereof on Construction Site; and U.S. Pat. No. 4,163,349, Insulated Building Panels; are but three of the many patents that describe modular sandwich building panels.

The present invention is an improvement over the prior art in that it utilizes cement-fiber boards or cement-woodchip boards as the outer surface members and polyurethane foam within the panels. Factory-built and installed housing components designed for field assembly and inter-connection keep labor costs to a minimum. Major differences that combine to distinguish the present invention from other systems are: (1) interior and/or exterior skins or faces that are fire rated, autoclaved, or compressed materials composed of cement-fiber or cement-woodchip boards; (2) injected, pressurized, fire rated foam core between the outer skins for complete adhesion between the form core and faces; (3) in-panel electrical, plumbing, door and window components; (4) low cost of interior and exterior finish application; (5) non-skilled labor construction of the entire structure; (6) meets class A fire rating; (7) high structural values; (8) high insulation value (R 23.35 for 4 inch wall); (9) earthquake resistant, (exceeds zone 4 requirements); (10) waterproof; (11) hurricane force wind resistant, (exceeds 200 mph as per NAVDOC); (12) approval as a State of California Factory-Built Housing system; (13) recognition by Department of Housing and Urban Development (HUD) under Category III acceptance in Handbook 4950.1, REV-2, *Technical Suitability of Products Program Processing Procedures;* (14) acceptance by Farmers Home Administration (FmHA) for rural housing development program financing.

SUMMARY OF THE INVENTION

The improved sandwich panel of the present invention includes inner and outer panel faces that have a foam core integrally bonded therebetween by the hardening and curing of a liquid foam during the manufacturing process. The faces of the preferred panel embodiments are composed of cement-fiber boards and/or cement-woodchip boards. The preferred sandwich panel has a male projecting lateral edge on one side and a female recess in the core on the opposite side edge. Both the top and bottom edges have recessed core sections. Thus, the panels, when assembled, are interlocking through the male-female engagement and are easily assembled by a single nailing line along the lateral edges. Likewise, the top edge and bottom edge recesses facilitate the placement of the panels upon a bottom sill and the insertion of a top plate within the top recess for simple nailing engagement of the bottom and top edges to the bottom sill and top plate, respectively. In the preferred embodiments, service components such as plumbing, electrical and heating are factory installed by engagement to one surface of the panel prior to the liquid foaming between the surfaces of the panel.

The preferred method of manufacturing the panels includes the installation of the male edge member prior to foaming and the utilization of edge recess forming members installed at the edges of-the panel assembly prior to the insertion of liquid foam therebetween. The removal of the edge recess forming members following the curing of the foam easily creates the edge recesses. Service components such as plumbing, electrical and heating are temporarily engaged to an inner surface of the faces prior to the insertion of liquid foam, such that these components are thereafter fixedly engaged within the panel assembly.

The method of construction of a structure utilizing the improved panel includes the installation of a bottom sill to a foundation or floor, the engagement of panel members to the bottom sill and to each other through the male-female side edge interconnection and the placement of a continuous top plate within the top edge recesses of the panels. Thereafter, by nailing, the assembled panels are engaged to the bottom sill, to each other through the male-female interconnection and the top sill. Interior wall panels are engaged to existing panels utilizing an attachment member that is first engaged to an interior face at a desired location and a bottom sill member that is engaged to the floor or foundation at the desired location. Thereafter, the interior wall panel is placed upon the bottom sill such that the female edge recess of the panel engages the attachment member and a top plate is placed within the top edge recess of the interior panel member. Thereafter, by nailing or the like, the interior wall panel is engaged to the bottom sill, the attachment member and the top plate. Many different types of panels may be constructed utilizing the present invention, including window panels, door panels, plumbing component panels, electrical component panels, heating component panels and the like.

These and other features and advantages of the present invention will become more apparent from the following detailed description of the preferred embodiments taken in conjunction with the accompanying drawings.

IN THE DRAWINGS

DETAILED DESCRIPTION OF THE PREFERRED EMBODIMENTS

Figure 1:
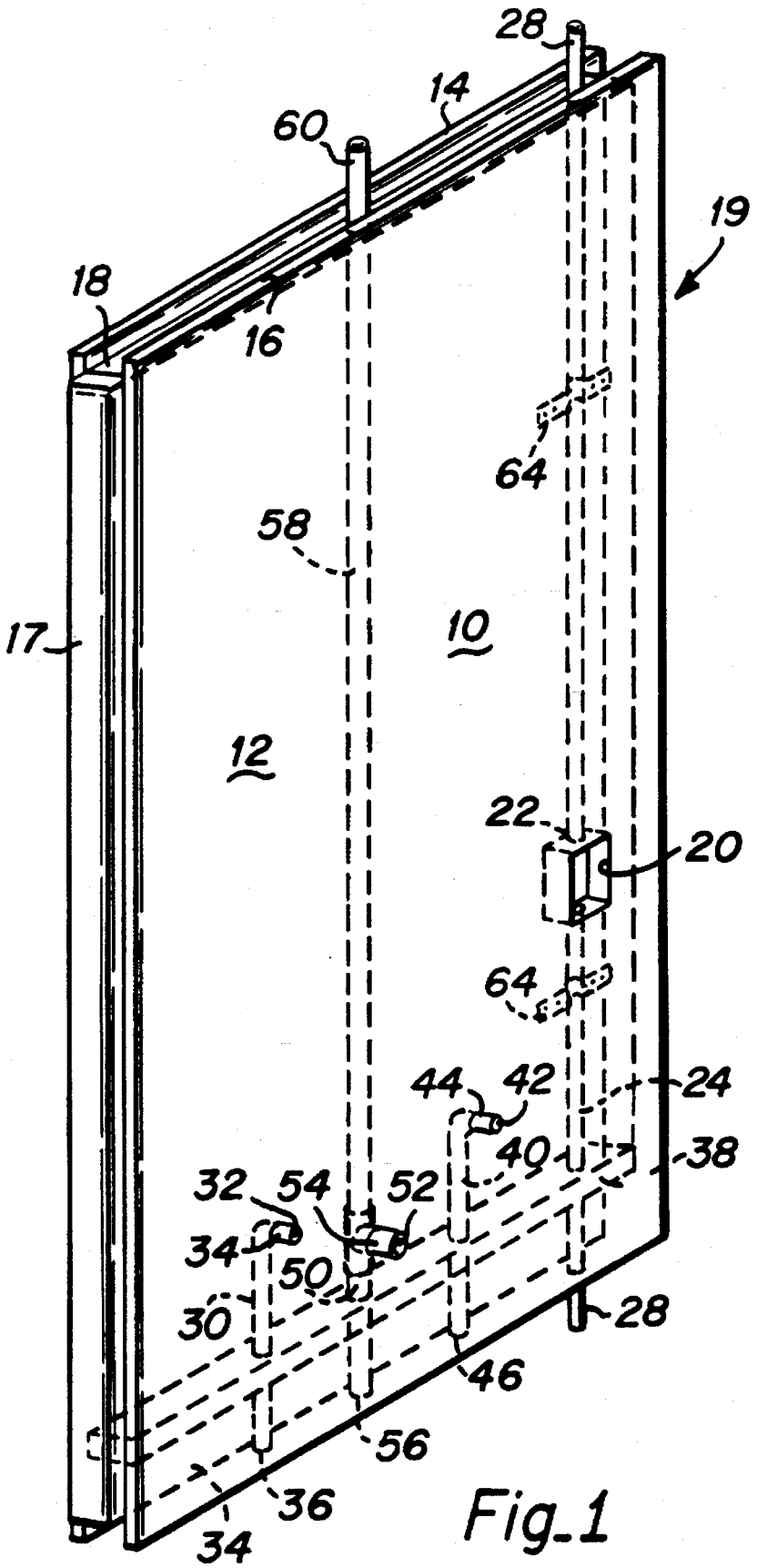
FIG. 1 is a perspective view of a typical sandwich panel of the present invention.

A typical individual foam core sandwich panel 10 of the present invention is depicted in FIG. 1. As depicted therein, the panel 10 includes an inner skin or face member 12 and an outer skin or face member 14, and a foam core layer 16 disposed between the inner and outer faces 12 and 14, respectively. A male edge member 17, preferably comprised of a 2×4 stud, or metal stud, high density plastic composite, high density polyurethane foam stud, is fixedly engaged between the faces 12 and 14 along a lateral edge of the panel 10, such that approximately ½ of the width of the engagement stud 17 projects from the side of the panel 10. The foam core is recessed from the edges of the panel members to form a top edge recess 18, lateral edge recess 19 and a bottom recess 112 which is depicted and described in FIG. 3.

By way of example, an electrical receptacle box 20 is engaged within a rectangular opening 22 formed through the inner face 12, and a solid, flexible plastic tubular electrical conduit 24 that is fire rated is disposed within the core 16 in engagement with the box 20, such that both of the outer ends 28 of the conduit 24 protrude outwardly from the core 16 of the panel member 10.

Also by way of example, a water service for a sink, or the like, is also included within the panel 10. The water service includes a hot water supply pipe 30 that is disposed within the core 16, having an outlet end 32 which protrudes through a circular opening 34 formed through the inner face 12. An outer connecting end 36 of the pipe 30 protrudes from the core 16 of the panel 10 through an interior stud 38 into an unfilled cavity 39 between the faces 12 and 14 at one end of the panel 10. The cavity 39 serves as an attachment access area for the water service installation. In like manner, a cold water service pipe 40 is disposed within the core 16, such that the outlet end 42 protrudes through a circular opening 44 formed through the inner face 12, and an outer end 46 protrudes from the edge of the core 16 into the access cavity 39. A drain pipe 50 is disposed within the core 16 such that its inlet end 52 projects through an opening 54 formed through the inner face 12, and an outer end 56 of the drain pipe 50 projects from the edge of the core 16 into the access cavity 39. The drain pipe system also includes a vent pipe 58 which projects upwardly (when the panel is installed) to an upper end 60 that projects from the upper edge of the core 16. While the water supply pipes 30 and 40 are shown and described as projecting downwardly, it is contemplated that the pipes may also project upwardly to connections at the top of a panel, in situations where the panels are installed in a concrete slab foundation or the like.

Figure 3:
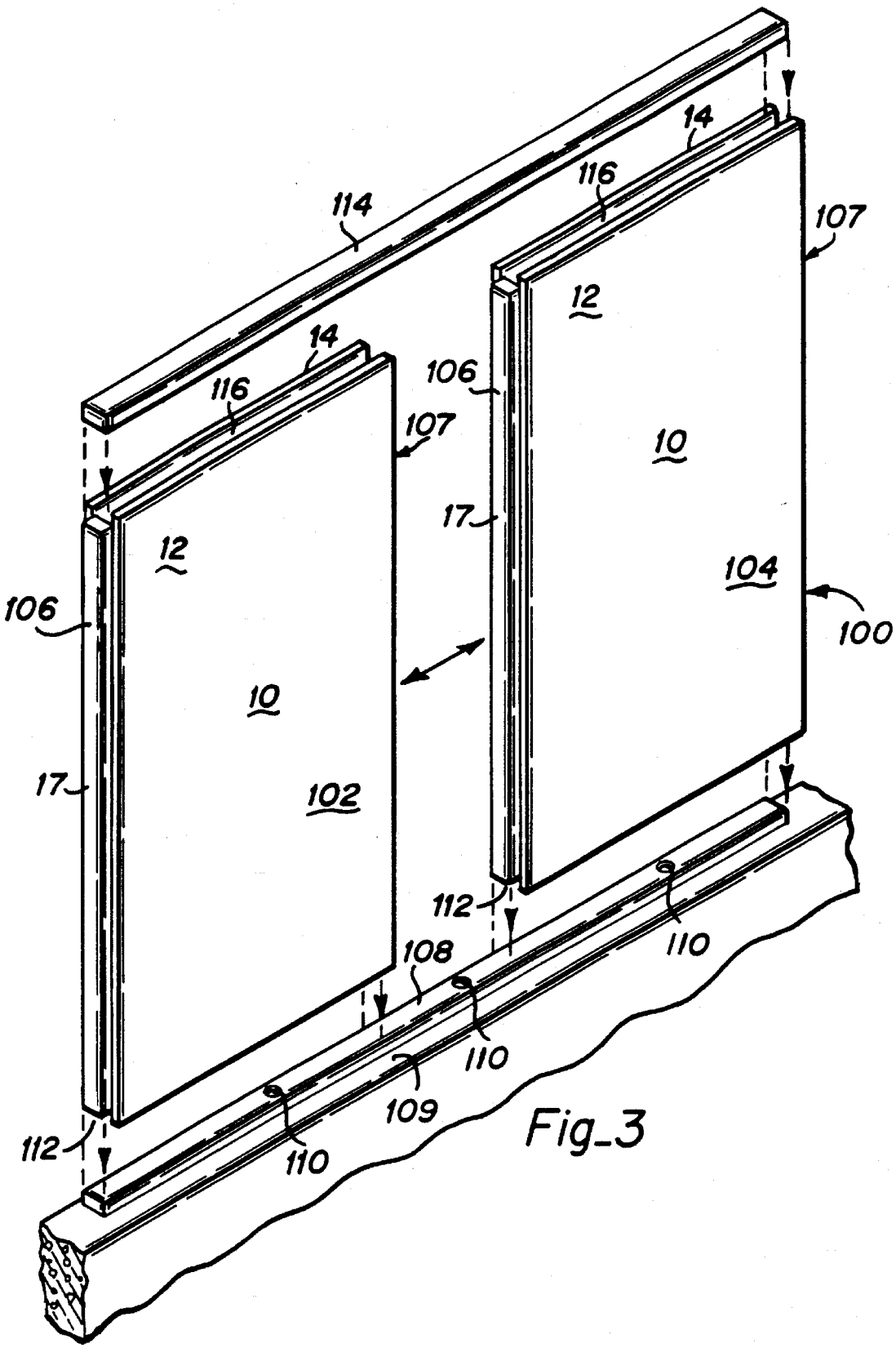
FIG. 3 is a perspective view depicting the engagement of two typical wall panels of the present invention.

It is to be understood that the electrical components and water service components depicted in FIG. 1 and described hereinabove are provided by way of example and panels having no internal components, such as are depicted in FIG. 3, are contemplated. Additionally, other necessary housing components, such as windows, doors, heating ducts, air conditioning ducts, telephone and other electrical conduit or raceways may also be installed within the panel members, as are described and depicted hereinbelow.

Figure 2:
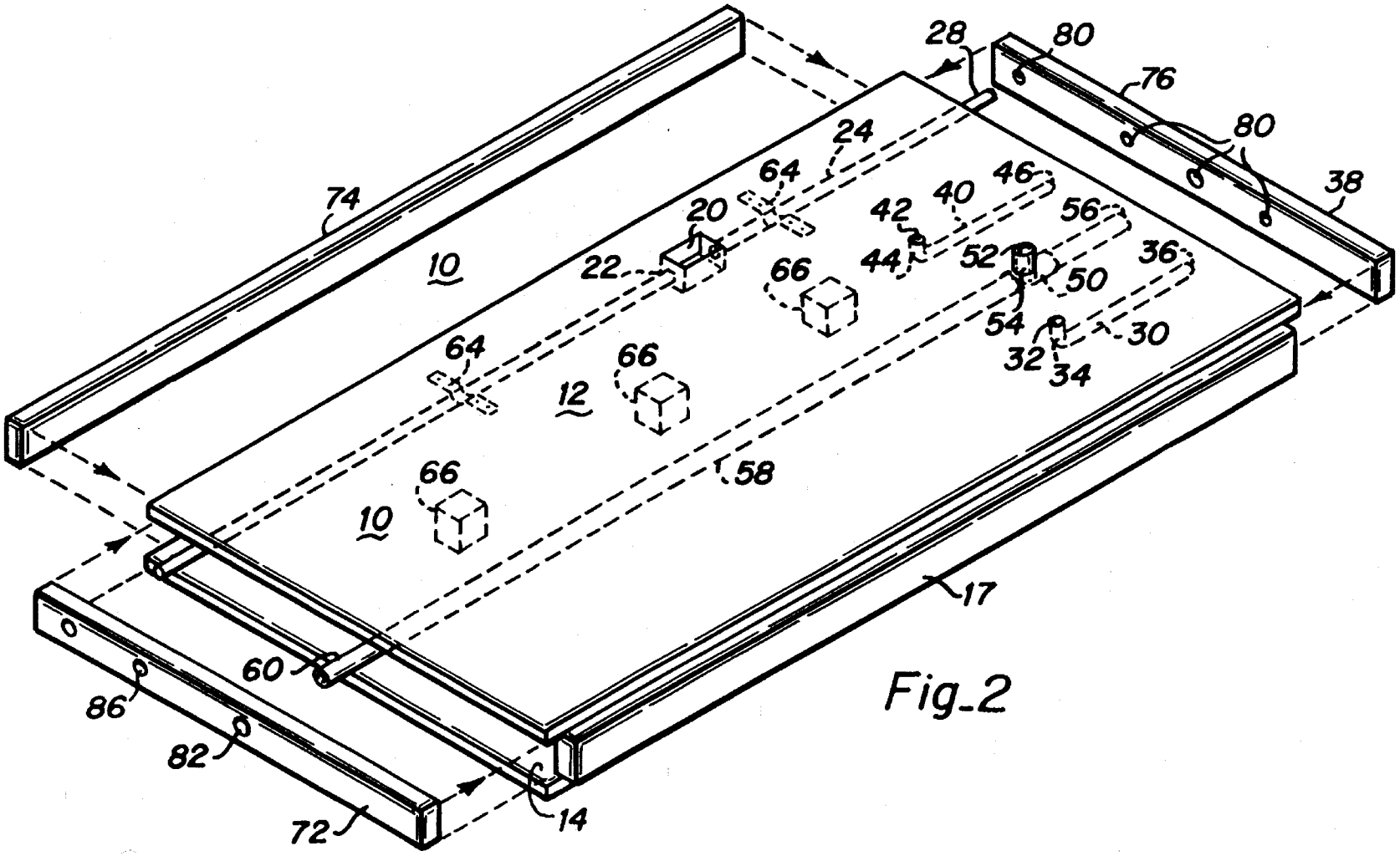
FIG. 2 is a perspective view depicting the manufacturing method of a typical panel of the present invention.

The method for manufacturing the panel depicted in FIG. 1 is now described with the aid of FIG. 2. Manufacturing begins with architectural plans which accurately identify and locate the position of each individual panel within a planned housing unit, and the specific location of the electrical, heating, water service and other systems within each panel. With particular reference to FIG. 2, when the location of the electrical and water service components is accurately determined, openings 22, 44, 54 and 34 are formed through the inner face 12. Thereafter, the electrical box 20 is installed within the opening 22 and the conduit 24 is attached to the box 20 and temporarily affixed to the inside surface of the face 12, such as by using an adhesive, electricians tape 64 or a similar temporary affixment. In like manner, the cold water pipe 30, hot water pipe 40 and drain 50 and vent pipe 58 are temporarily affixed to the inside surface of the face 12.

The male edge forming stud 17 is then engaged to the face 12, such as by tack nailing, and one or more spacers 66 (three being shown in FIG. 2) comprised of hard polyurethane blocks are centrally placed upon face 12. Three panel recess edge forming members, 72, 74 and 76 are first coated with a release agent (a lubricant such as a grease or 30 weight oil) and installed at the edges of the face 12 in such a manner as to later produce the edge recesses 18 and 19 having a desired depth when the edge studs 72, 74 and 76 are removed, as described below. An alternative to using independent edge forming studs 72, 74 and 76 would be to provide a hinged attachment of the three members 72, 74 and 76 at their ends. The three hinged members could be formed with teflon coated aluminum and the panel forming process would be simplified with their use.

The upper face 14 is then placed upon the four installed edge studs 17, 72, 74 and 76 and the spacers 66. The stud 17 is then fixed in position using nails on four inch centers from both faces 12 and 14. It is to be noted that a plurality of openings 82 and 80 are formed through the upper or lower edge studs 72 or 76, respectively, at aligned locations to permit the projecting ends 60, 28, 36, 46 and 56 of the electrical and water service to project therethrough. It is to be specifically noted that the lower edge stud 76 in this particular panel example is to be internally positioned as stud 38 in FIG. 1 in order to create the access cavity 39. Additionally, stud 38 is not coated with a release compound as it will remain within the panel.

One or more foam injection holes 86 are formed at appropriate locations through the edge studs, 72 and/or 76 to permit the injection of a two component liquid, expanding, polyurethane foam material into the panel cavity. The hollow sandwich panel assembly, consisting of the upper face 14, lower, inner face 12 with any temporarily attached electrical, water or other services, the spacers 66 and the edge studs 17, 72, 74 and 76 is placed between the platens of a press that is large enough and strong enough to hold the components together during the foam injection operation. It has been found that the injection of the two component polyurethane foam into an enclosed cavity of the hollow sandwich panel creates significant pressure within the panel, which will easily separate the sandwich panel members unless they are held together by the pressure of the platens of a strong press. In the present invention, a pressure of approximately 1440 pounds per square foot upon the faces 12 and 14 is utilized to hold the panel assemblage together during the foam injection process.

After the hollow sandwich panel has been placed on the press and suitable pressure is applied to the outer and inner surfaces of the assemblage, an extension nozzle of the polyurethane foaming system is inserted through the openings 86 and the expanding polyurethane foam is injected to all cavities and areas of the hollow panel assemblage within the press. As the foam expands it creates significant pressure against all surfaces of the panel and entirely fills the accessible hollow space of the panel, typically protruding through any small gaps in the various openings for the various components. The polyurethane foam cures in approximately 30 to 45 minutes, after which the foamed sandwich panel is removed from the press, the edge studs 72, 74 and 76 or the three hinged unitized member (if appropriate) are removed and the panel is cleaned up and ready for usage, as discussed herebelow. In the preferred manufacturing method, a two component polyurethane foam creating apparatus is utilized. This apparatus includes a first liquid component of an isocyanate and a second liquid component of a polyol plus a blowing agent that is appropriate to achieve an acceptable cell structure in the core material. These components are supplied through two pressurized lines to a mixing head nozzle that mixes the two components and froths or pours the combined mixture outwardly. Such a pressurized polyurethane foam injection system is commercially available from Canon USA, Inc., 1235 Freedom Road Mars, Pa. 16046 and identified as the high pressure polyurethane metering unit system, Model Number L20, L40, L100.

The preferred polyurethane foam is a two-component, low-viscosity, chemical system. The formulation, during the foaming process, has excellent (long) flowability and adhesion to the inner surfaces of faces 12 and 14 and is designed for use through most types of urethane injection machines. The main characteristics are: (1) density (nominal) 2.0 to 2.5 pounds per cubic foot; (2) closed cell content is over 90 percent; (3) compressive strength (parallel to rise) is 34 pounds per square inch; (4) tensile strength is 55 pounds per square inch; (5) adhesion is 55 pounds per square inch; (6) shear is 25 pounds per square inch; (7) water absorption is 0.05 pounds per square foot; (8) water vapor transmission is 2.0 perms. The two-component polyurethane foam formulation is manufactured by The Burtin Corporation, Santa Ana, Calif.

The panel's combination of the cement-fiber board faces 12 and 14 (or alternatively cement-woodchip board faces) with the cured polyurethane foam core 16 creates a sandwich panel with exceptional physical properties. These properties arise primarily from the very strong bonding of the cured foam core 16 to the inner surfaces of the faces 12 and 14, resulting in a combined sandwich panel structure whose physical properties far exceed those of the individual components. The usage of the male edge stud 17 and female edge recess 19 creates interlocking panel members that are easy and quick to join together in a building structure, as discussed below.

Structural testing has been performed on the panel 10 to meet ASTM E-72 for racking shear, compression, and transverse loads, with test results exceeding Zone 4 earthquake requirements. Combined Axial and Bending Load, ASTM E-72, under NAVDOC requirements for hurricane force winds, calculates in excess of 200 miles per hour. Compression load results exceed 2000 pounds per linear foot. All of the testing was performed with an allowable safety factor of three.

With regard to the thermal insulating properties of the panel 10, an R 23.35 value for a 4 inch wall is attained. A higher R value may be obtained by increasing the foam thickness. A 6 inch wall will exceed a R 35 insulation value based on conservative calculations.

The polyurethane foam will not dissociate thermally until 365 degrees C. is reached and in some cases is stable at 500 degrees C. with a combustion temperature of 12,355 degrees F. The panel 10 has been tested and has been approved under U.B.C. 17-5 Room Corner Fire Test. Therefore, the panel 10 qualifies as a thermal barrier and does not require sheetrock installation.

The panel 10 has many versatile and desired values needed in the building field, such as surface finish, high density, resistance to moisture intake, high modulus of rupture and internal bond, excellent compressive strength and high modulus of elasticity, virtually indestructible, low heat conductivity, sound absorption qualities (28 dB), waterproof, proof resistance to termites, vermin, insects, and proof against rot or mold.

In the preferred panel 10, electrical conduits or raceways are an approved ENT plastic flexible conduit or raceway that is fire rated and listed to meet all applicable codes. Hot and cold water lines are approved copper or plastic as allowed by applicable code restrictions. Sewer waste and vent lines are approved cast iron, copper, or plastic as allowed by applicable code restrictions.

The autoclaved cement-fiber board that is used as the faces 10 and 12 is known as Hardiboard and/or Hardisoffit Panels, and is manufactured by James Hardi Building Products, Inc., Fontana, Calif. The compressed cement-woodchip board that may also be used as the faces 10 and 12 is manufactured by the Bison-Werke Company, Grupo Guadiana, Durango, Durango, Mexico.

Figure 4:
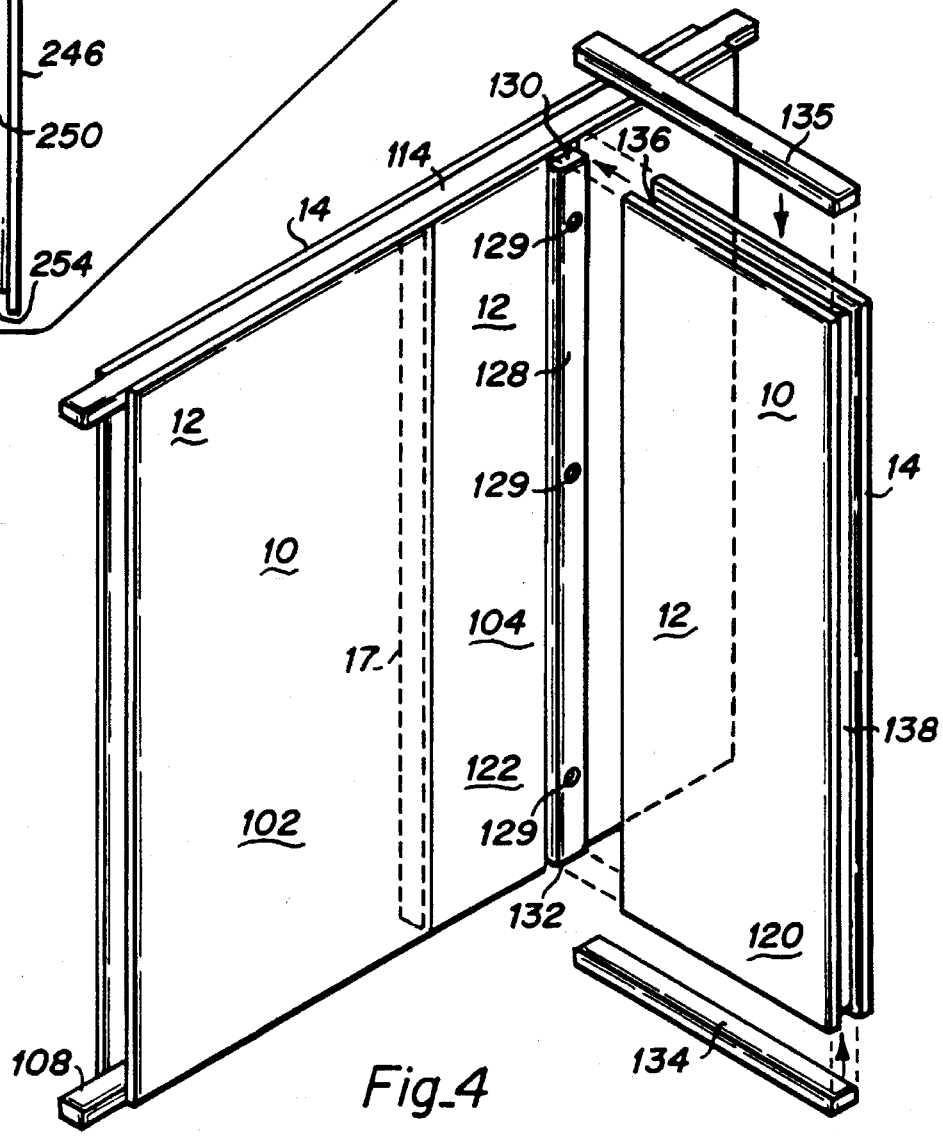
FIG. 4 is a perspective view depicting the engagement of an inner wall panel to other wall panels of the present invention.

As depicted in FIGS. 3 and 4, the preferred panel system 100 consists of loadbearing or non-loadbearing panel assemblies 10 that are 4 feet wide by 8 feet long and have a 3.5 inch thick polyurethane foam core with a 0.25 inch cement-fiber face 12 and 14 on each side. However, panels may be as long as 36 feet with widths greater than four feet. A typical panel 102 and 104 has a male side edge 106 formed with a projecting stud 17 and a female side edge formed of a recess 107 that has a depth that is approximately ½ of the width of a 2×4 stud; in the preferred embodiment the depth of the edge recess 107 is 11/16 inches, such that a small tolerance gap will exist between adjoining panels 102 and 104. The system 100 which is made up of wall, floor, ceiling or roof panels, is supported by a 2×4 inch continuous redwood or treated wood bottom sill member 108 that is bolted to a concrete foundation 109 with 0.50 inch diameter by 10 inch long anchor bolts 110 spaced at 48 inches on center. The depth of the panel's bottom edge recess 112 is thus approximately the full width of a nominal 2×4, or, in the preferred embodiment 1½ inches, to provide for a small tolerance gap. A 2×4 inch top plate 114 of No. 2 Douglas Fir or equivalent is continuous along the wall top and is recessed 116 within the panel facings so to be flush with the top of the panels. The depth of the top edge recess 116 is thus approximately the full width of a nominal 2×4, or, in the preferred embodiment 1½ inches, to provide for a small tolerance gap. All panel edges along each face are nailed to the studs and plates with corrosion resistant 1.25 inch 11 gage galvanized roofing nails spaced 4 inches on center.

The preferred assembly method for the joinder of an interior wall 120 to an adjoining wall 122 is depicted in FIG.

4. Firstly, a wall attachment stud 128 is affixed to the surface 12 of a wall section 122 at the desired location preferably utilizing three wallgrip screw type anchor attachment members 129. An upper notch 130 and a lower notch 132 are formed in the face 12, to permit the engagement of the bottom sill member 134 and top sill members 135. The depth of the recess 136 in the inner edge of the panel 120 is formed to accept the full width of the 2×4 128; this depth is 1½ inches in the preferred embodiment to provide a small tolerance gap. The edges of the faces of panel 120 are then nailed to the stud 128. It is to be noted that panel 120 is also shown with a second female edge 138 to demonstrate that different panel configurations are contemplated.

Figure 5:
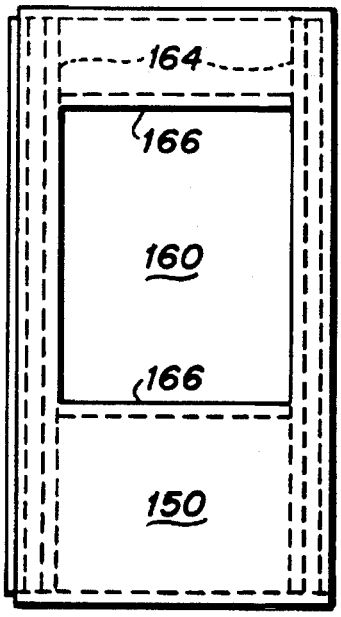
FIG. 5 is a front elevational view of a window panel of the present invention.

Some typical panels are depicted in FIGS. 5, 6, 7 and 8; however, the present invention is not to be limited to these depicted panels as many other panels and configurations of panels will be obvious to those of ordinary skill in the art upon examination thereof. FIG. 5 depicts a sandwich panel 150 having a window opening 160 formed therethrough, such that a prefabricated window assembly (not shown) can be installed in the opening 160 following the installation of the panel 150 in a building. The window panel 150 includes two vertical window framing trimmer studs 164 and two horizontal window framing trimmer studs 166, such that the opening 160 is formed between the vertical trimmers 164 and the horizontal trimmers 166. To manufacture the panel 150, the vertical and horizontal studs 164 and 166 are assembled upon the lower face (the horizontal studs being preferably engaged to the vertical studs by nailing), the edge forming studs 17, 72, 74, and 76 and spacers 66, as depicted in FIG. 2 are installed on the lower face and the upper face is placed thereon. Thereafter, the studs 164, 166 are nailed in place to the faces, the assembled panel is placed in the press, pressure is applied and the foam core is injected into the panel. It is to be noted that four separate cavities are created by the horizontal and vertical studs 166 and 164, respectively, such that appropriate foam insertion openings 86 must be provided in the edge forming studs to facilitate the insertion of the foam into each cavity. After the foam has cured, the edge studs 72, 74 and 76 are removed; however, the internal trimmers 164 and 166 remain within the panel for usage in engaging the window within the panel. The window opening 160 is then cut into each face 12 and 14 of the sandwich panel 150 using the trimmer studs 164 and 166 as guides.

Figure 6:
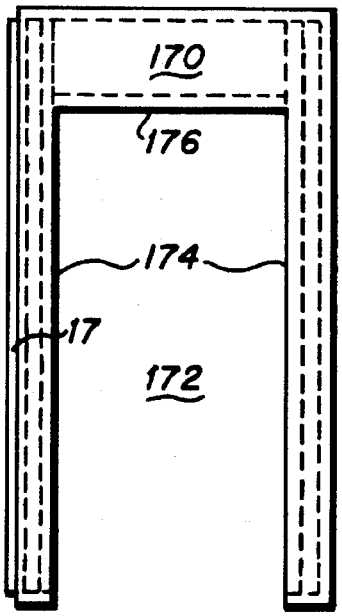
FIG. 6 is a front elevational view of a door panel of the present invention.

FIG. 6 depicts a door panel 170, wherein the door opening is centrally disposed relative to the face of the panel. The panel 170 is manufactured in a similar manner to the window panel 150. That is, vertical studs 174 and horizontal stud 176 are engaged within the panel by nailing to the faces. The edge forming studs and spacers are engaged to the panel, the panel is placed within the press and foam is inserted into the three separate cavities (two side cavities and the top cavity). After curing the edge forming studs are removed whereas the door frame forming studs 174 and 176 remain within the panel. The door opening 172 is then cut into the two panel faces using the studs 174 and 176 as guides.

Figure 7:
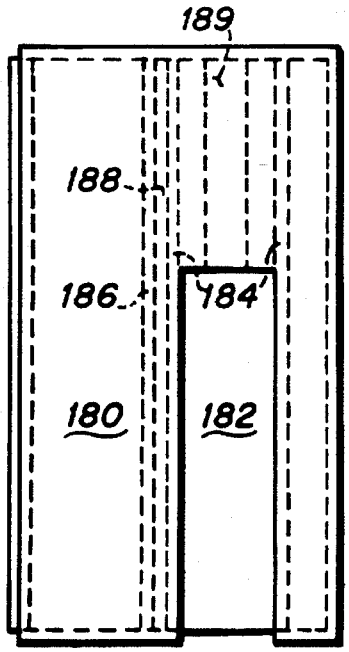
FIG. 7 is a front elevational view of a water heater panel of the present invention.

FIG. 7 depicts a wall heater panel 180 having an overhead gas supply line. The panel 180 includes a rectangular opening 182 formed through only the inner face of the panel 180. Two vertical studs 184 are placed on each side of the rectangular opening 182 to provide vertical framing for it. A third vertical stud 186 is placed a small distance away from the innermost vertical stud 184 to provide a channel for the insertion of a gas supply pipe 188. To manufacture the wall heater panel 180, the studs 184 and 186 are engaged between the faces, the gas line 188 is fixedly engaged to one of the studs 186, the edge forming studs and spacers are placed between the panels, the sandwich is placed within the press and foam is injected only into the outermost cavities, such that the gas line cavity remains empty of foam and the wall heater cavity between vertical studs 184 remains empty of foam. The wall heater opening 182 is then cut into the inner face 12 using the studs 184 as guides. After the panel is installed within a structure, the wall heater, with an exhaust pipe 189 (having appropriate exhaust fixtures installed thereabove) is installed in the cavity such that the wall heater unit is exposed through opening 182.

Figure 8:
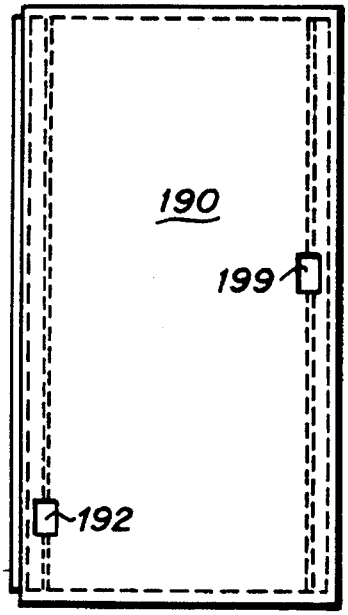
FIG. 8 is a front elevational view of a typical electrical panel of the present invention.

FIG. 8 depicts a typical electrical panel having a baseboard receptacle and a wall switch. As was described hereinabove, to manufacture the electrical panel 190, openings are formed in the inner face to accept a receptacle box 192 and switch box 194. The receptacle box, the switch box and vertical electrical raceways 196, which preferably extend both above and below the boxes such that connecting wiring may be inserted from either above or below the panel (as desired), are installed, the edge forming studs and spacers are engaged, the assembled panel is placed within a press and foam is injected into the panel. Following the installation of the electrical panel 190 into a building, the appropriate electrical fixtures and wiring are installed within the boxes and raceways.

Figure 9:
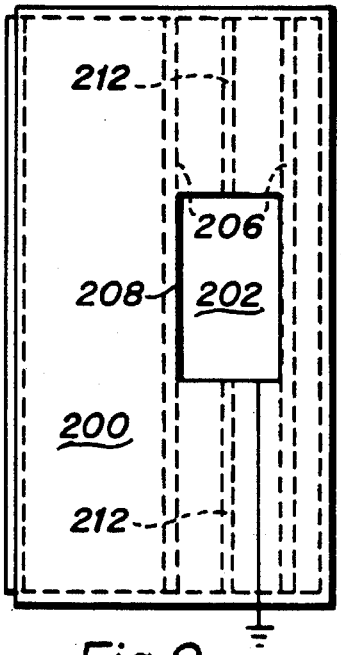
FIG. 9 is a front elevational view of a meter/main panel of the present invention.

FIG. 9 depicts an electrical meter/main panel 200 having a rectangular opening 202 formed through the exterior face of the panel 200. Two vertical studs 206 are placed on each side of the rectangular opening 202 to provide vertical framing for it. A rectangular meter holding box 208 is installed in the opening 202 and attached to the studs 206, such as by nailing. Appropriately sized electrical conduit 212 is engaged to the box 208 for the later installation of electrical wires therethrough. To manufacture the panel 200 the rectangular opening 202 is cut into the exterior face of the panel. The studs 206, box 208 and conduit 212 are then installed upon the panel face, the edge forming studs and spacers are installed and the interior face is then engaged to create a sandwich assembly which is thereafter placed within the press. Foam is injected into all of the cavities of the panel. After the panel is installed in a structure, a code compliant electrical meter/main is installed within the box 208 and appropriate wiring is fed through the conduit 212.

Figure 10:
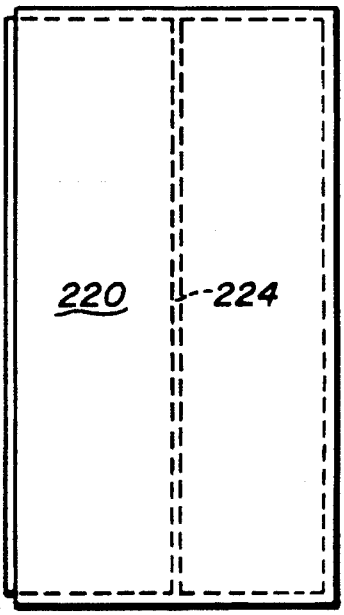
FIG. 10 is a front elevational view of a roof/ceiling panel of the present invention.

FIG. 10 depicts a typical roof/ceiling panel 220, which may be as long as 36 feet and wider than four feet, which includes a centrally disposed vertical strengthening stud 224. To manufacture the panel 220 the stud is engaged to one face of the panel, the edge forming studs are placed between the panels, the sandwich is placed within the press and foam is injected into the two cavities (one cavity being located on each side of the centrally disposed stud 224).

Figure 11:
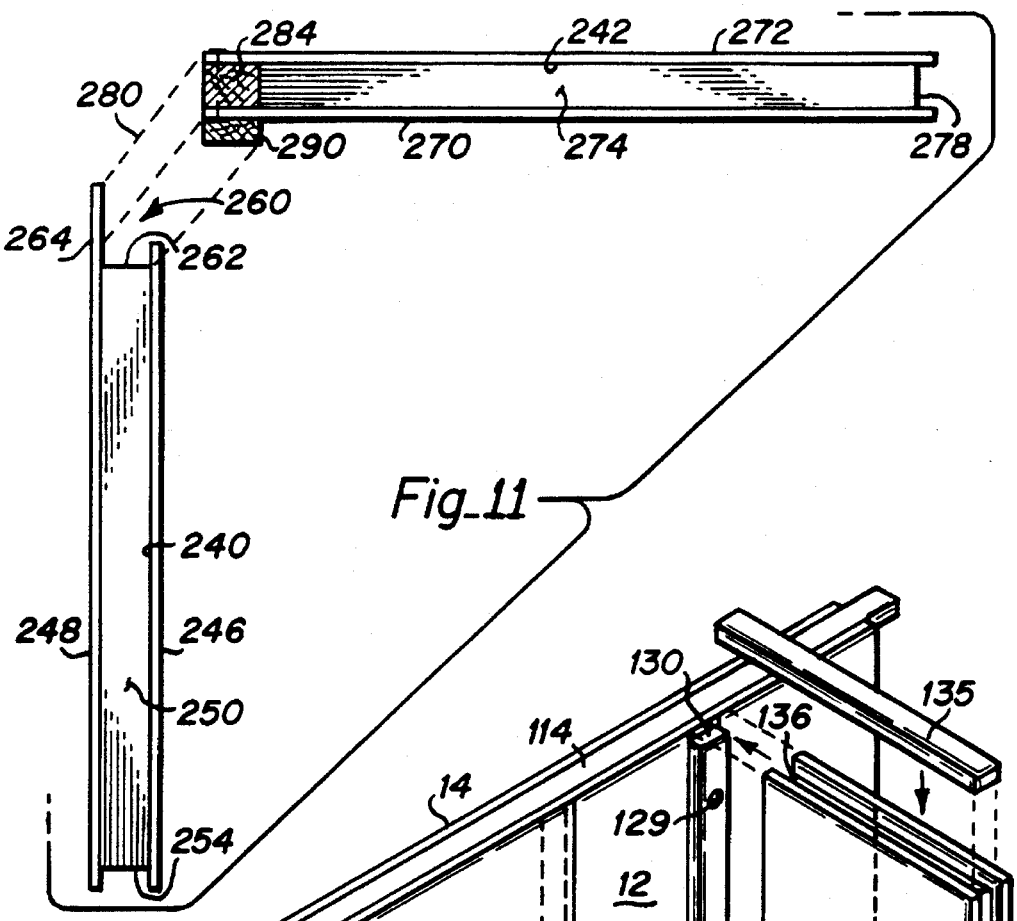
FIG. 11 is a top plan view of a typical corner engagement of two panels of the present invention.

FIG. 11 depicts the assembly of a typical corner utilizing specially formed panels 240 and 242, formed in accordance with the present invention. Panel 240 includes an inner face 246, an outer face 248 and a foam core 250; it has a typical edge recess for the joinder to a subsequent panel (not shown) utilizing a 2×4 stud, as depicted in FIG. 2. The corner edge 260 of the panel 240 includes a full stud recess 262 (similar to the full stud recess 136 in FIG. 4) and an extending edge 264 of the outer face 248.

Panel 242 is formed in accordance with the present invention, having an inner face 270, an outer face 272 and a foam core 274. The distal edge recess 278 is formed for attachment to a 2×4 stud as was recess 254 of panel 240. The corner edge 280 of panel 242 is specially formed with a flush 4×4 stud 284 which is affixed in the panel forming process in place of the male edge stud 17.

To join the panels 240 and 242 to form a corner, a 2×4 stud 290 is first engaged to the inner surface edge of panel 242, in a manner similar to the joinder of stud 128 in FIG. 4. Thereafter, the panel 242 with attached stud 290 is fitted into the edge recess 260 of panel 240 and the two panels are nailed together through the edges 264 and 262 of panel 240.

Construction methods for establishing wall/ceiling joints, wall/roof joints, floor/wall joints, foundation/floor and/or foundation/wall joints, and other necessary structural engagements are deemed to be within the knowledge of the skilled worker having read and understood the disclosure set forth above. A detailed description of such joints is therefore deemed unnecessary to the comprehension of the invention.

Utilizing the panels 10 and panel assembly methods discussed herein, construction time frame of a structure is greatly improved because the panels are easily and quickly engaged together, and many plumbing, electrical, mechanical, doors, windows, electrical meter-main panel, and other components are installed at the manufacturing facility prior to transporting. The panels weigh 140 to 165 pounds and are easily handled by two average size persons. Carpenters, electricians, plumbers, sheetrock installers, or other skilled labor, are not required, with the exception of a concrete finisher and roofer. As with most cement formulated products, the panel 10 are not suitable for use where subjected to prolonged contact with hot condensed water, organic or inorganic acids, salt solution from sulfate, magnesium salt, iron chloride, sugar solution, vegetable oil and fat, or where highly concentrated acidic gasses and fumes combine with moisture.

While the invention has been particularly shown and described with reference to certain preferred embodiments, it will be understood by those skilled in the art that various alterations and modifications in form and detail may be made therein. Accordingly, it is intended that the following claims cover all such alterations and modifications as may fall within the true spirit and scope of the invention.

What I claim is:

1. An improved structural sandwich panel comprising:

a first thin, generally rectangular panel face member;

a second thin, generally rectangular panel face member;

a rigid foam core being disposed between said first and second face members, said core being adhered to an inner surface of each said face member by an insertion of said foam between said first and second members in a liquid state, followed by a drying and curing of said foam in place between said first and second face members;

a male edge member being composed of a structural framing material, and being partially disposed between said first and second face members and partially projecting outwardly from a side edge of said panel; said male edge member being at least partially held in place by direct adherence with said foam core.

2. An improved sandwich panel as described in claim 1 wherein at least one of said first and second face members is comprised of a material from the group consisting of a cement-fiber board composition material and a cement-woodchip board composition material.

3. An improved structural sandwich panel as described in claim 1 or 2 wherein said panel includes a female recessed edge disposed in an opposite side edge from said male edge member.

4. An improved structural sandwich panel as described in claim 3 wherein one or more service component openings are formed through at least one of said first or second face members, and wherein said panel further includes at least one service component disposed within said core, and wherein portions of said service components project through said openings, said service components including one or more components from the group consisting of plumbing components, electrical components and heating components.

5. An improved structural sandwich panel as described in claim 4 wherein an access cavity, being devoid of foam, is formed between said first and second face members, whereby the installation and maintenance of said service components can be accomplished.

* * * * *